US006648536B1

(12) United States Patent
Bellue

(10) Patent No.: US 6,648,536 B1
(45) Date of Patent: Nov. 18, 2003

(54) ERGONOMIC WRITING INSTRUMENT

(76) Inventor: John W. Bellue, P.O. Box 59, Huntington, WV (US) 25701

( * ) Notice: Subject to any disclaimer, the term of this patent is extended or adjusted under 35 U.S.C. 154(b) by 0 days.

(21) Appl. No.: 10/199,787

(22) Filed: Jul. 19, 2002

(51) Int. Cl.[7] ..... A46B 5/02

(52) U.S. Cl. ..... 401/6; 401/96; 16/430; D19/41

(58) Field of Search ..... 401/6, 7, 195, 401/88, 96, 97, 52; D19/50, 47, 41; 16/430

(56) References Cited

U.S. PATENT DOCUMENTS

D136,595 S * 11/1943 Pleasants ..... D19/50
4,149,811 A * 4/1979 Coffman ..... 401/6
5,228,794 A * 7/1993 Hochstetler ..... 401/6
5,893,671 A * 4/1999 Bellue ..... 401/6
5,984,556 A * 11/1999 Gray et al. ..... 401/96

* cited by examiner

*Primary Examiner*—David J. Walczak
(74) *Attorney, Agent, or Firm*—Bowles Rice McDavid Graff & Love, PLLC; John J. Giblin, Jr.

(57) ABSTRACT

A writing instrument having an ergonomic configuration and methods for making the instrument. The instrument is elongated having an equilateral triangular cross-section and having a uniform partial twist along the length thereof. The partial twist permits flat surface engagement for the thumb, index finger and middle finger and for the dorsal first web space of the user's hand. The uniform twist in combination with the equilateral cross-sectional shape also permits tight packing in bulk. A method for making the instrument in the form of a rigid pencil is also provided.

7 Claims, 3 Drawing Sheets

ERGONOMIC WRITING INSTRUMENT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable

BACKGROUND OF THE INVENTION

1. Field of the Invention

This invention is directed to manually held and manually manipulated writing implements with means to conform to the hand of the user and to methods for making thereof.

2. Description of the Related Art

Various well known writing instruments have found common use and appeal. Examples include conventional hexagonal cross-sectional pencil shaped to reduce unintended rolling and slippage, and round cross-sectional pens having polymeric slip-reducing materials for the shells thereof and having cap clips for reducing rolling and for attaching to pockets. Generally, these designs have not been as ergonomically well designed for prolonged periods of use based on the way that such pencils and pens are conventionally held during extended writing periods. Additionally, many of these prior pens have a tendency to roll on desk tops.

Prior attempts to improve the ergonomic designs of such pens and pencils have for example lead to the use of various scooped portions for receiving the index finger or have lead to non-uniform curvatures. For pencils, the bodies of which are consumed during use, the use of a non-uniform shape would undesirably result in frequently changing grip configurations following sharpening. Also, various ergonomic pencil configurations would not be suitable for being sharpened in conventional pencil sharpeners. Prior writing instruments have been disclosed in Hochstetler U.S. Pat. No. 5,228,794 issued Jul. 20, 1993 which discloses a writing instrument having groove spirals around a shell; Pleasants U.S. Design Pat. No. 136,595 issued Nov. 2, 1943 which discloses a pen holder Lamb U.S. Design Pat. No. 202,395 issued Sep. 21, 1965 which discloses a holder for a writing instrument having a non-uniform cross-section; Zeckendorf U.S. Design Pat. No. 18,032 issued Jan. 24, 1888 which discloses a lead pencil having a pair of flat sides and a curved side; Eckert et al U.S. Design Pat. No. 22,524 issued Jun. 13, 1893 which discloses a pen holder having spirals; Fuchs U.S. Design Pat. No. 191,341 issued Sep. 12, 1961 which discloses a mechanical pencil; Anderson U.S. Design Pat. No. 237,705 issued Nov. 18, 1975 which discloses a pen; Johansson U.S. Design Pat. No. 323,350 issued Jan. 21, 1992 which discloses a pen; Tucker U.S. Design Pat. No. 31,072 issued Jun. 27, 1899 which discloses a pencil having spirally formed ribs; Kageyama et al. U.S. Pat. No. 5,090, 831 issued Feb. 25, 1992 which discloses a writing instrument; Kageyama U.S. Pat. No. 5,207,522 issued May 4, 1993 which discloses a mechanical pencil; and Kageyama et al. U.S. Pat. No. 5,236,270 issued Aug. 17, 1993 which discloses a writing tool; all of which are incorporated herein by reference in their entireties.

The non-uniform design of some of these designs could result in inefficient packaging; some of the uniform designs do not provide for ease in picking up the writing utensil from a resting position; and some of the spiral designs are too tightly wound to provide for comfortable long term writing.

U.S. Pat. No. 5,893,671 ("Patent '671") issued on Apr. 13, 1999 to the instant inventor discloses a writing instrument with a triangular cross section and a uniform spiral twist of the cross section axially along the length of the instrument. However the pitch of the spiral twist is limited to between 150 and 210 degrees total along the overall length of the instrument. As disclosed in Patent '671, the ergonomic alignment of the surfaces of the writing instrument with the parts of the right hand were achieved with an overall twist of between 150 and 210 degrees over the total instrument length, but only when the direction of twist was counter-clockwise, traversing longitudinally away from the viewer. Similarly, the same ergonomic result was achieved if held in the left hand when the direction of twist was clockwise. Patent '671 failed to address the degree of twist necessary to obtain an ergonomic result for a writing instrument with a clockwise twist held in the right hand, or similarly for an instrument with a counter-clockwise twist held in the left hand.

SUMMARY OF THE INVENTION

The present invention involves a writing instrument having a ergonomic configuration. The instrument is elongated having an equilateral triangular cross-section and having a uniform partial twist along the length thereof. The partial twist permits flat surface engagement for the thumb, index finger, and middle finger and for the dorsal first web space of the hand. The uniform twist in combination with the equilateral cross-sectional shape also permits tight packing in bulk, and the partial twist permits flat sided engagement with the resting surface (desk top).

DETAILED DESCRIPTION OF THE INVENTION

Figure 1:
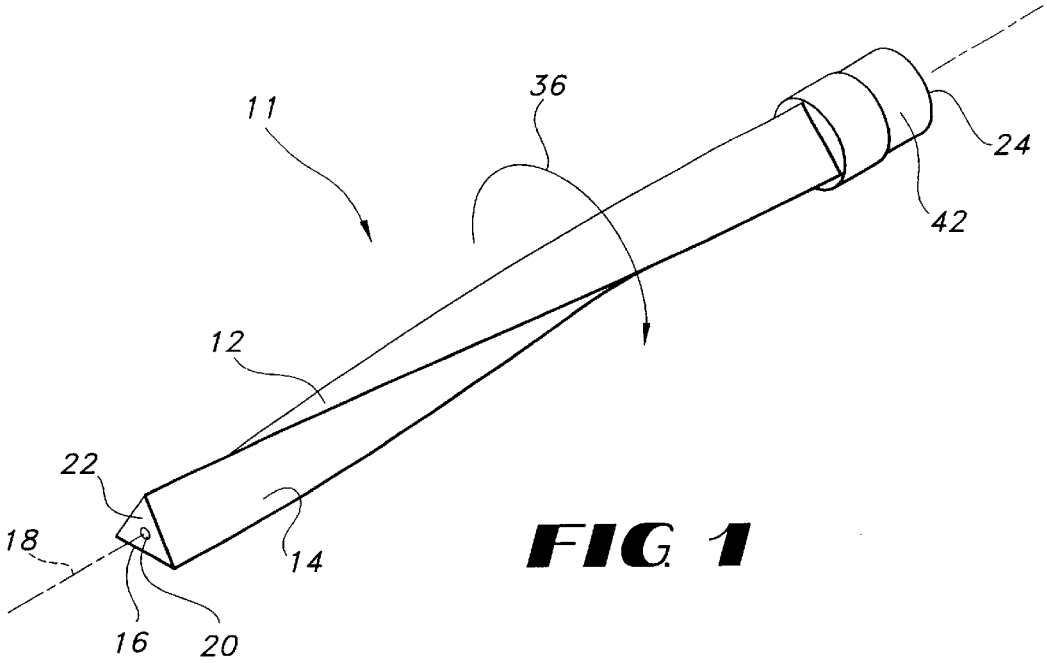
FIG. 1 is a perspective view of a writing instrument for a right hand configuration according to the present invention, showing the embodiment with an eraser at the distal end.
Figure 2:
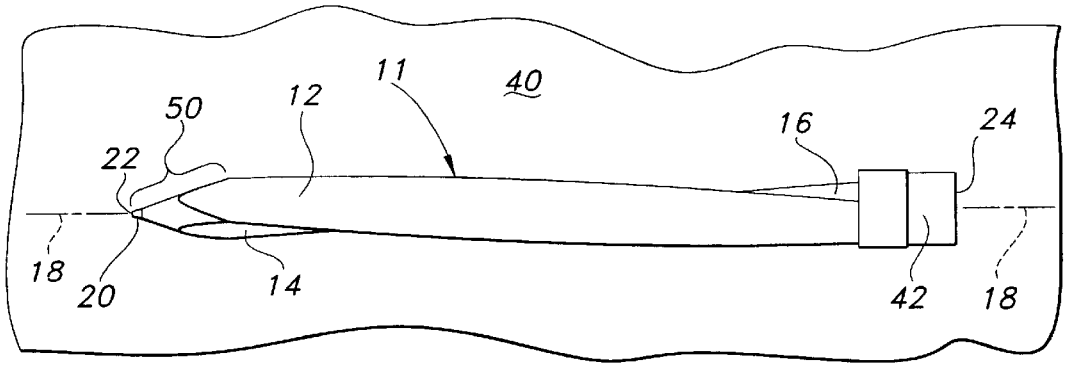
FIG. 2 is a plan view of a desk having thereon the writing instrument of FIG. 1.
Figure 3:
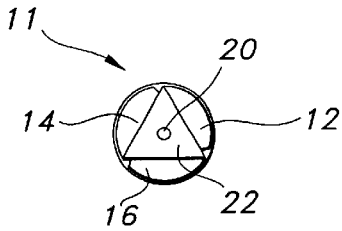
FIG. 3 is a front end elevational view of the writing instrument of FIG. 1.
Figure 4:
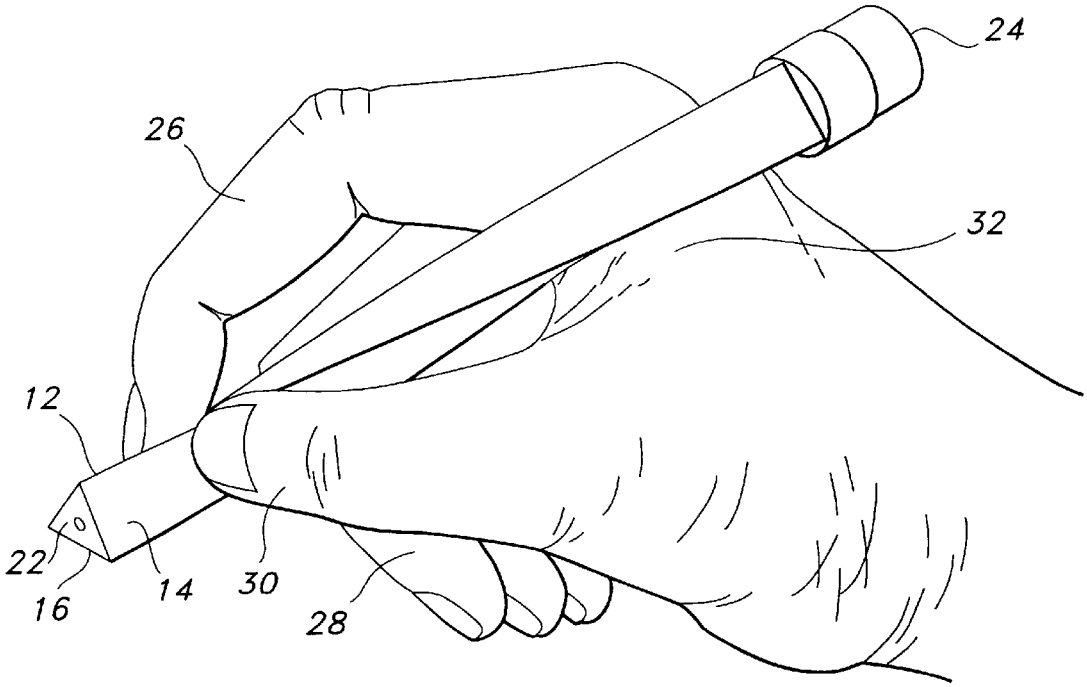
FIG. 4 is a perspective view of the right hand of a user holding the instrument of the present invention.

As best shown in FIG. 1, a writing instrument (11) such as a lead pencil, has an equilateral triangular vertical cross-section, preferably with slightly arcuate (rounded) vertices (edges) where the sides thereof (12, 14, 16) come together which provides the instrument (11) with the three sides (12, 14, 16). The sides (12, 14, 16) gently spiral about a central longitudinal axis (18) of the instrument (11). A writing element (20), such as a pencil lead, is positioned coaxially along the central longitudinal axis of the writing instrument (11). The pitch of the spiral is preferably a one-quarter turn from the proximal end (22) of the instrument (11) to the distal end (24) of the instrument (11), based on an overall preferred length of seven inches typical in the art for pencils and similar writing instruments. The gentle twist of the triangular cross-section of the instrument (11) permits the instrument (11) to have one of the three flat sides (12, 14, 16) in parallel contact with the tangent of the contact surface of index finger (26), middle finger (28), thumb (30) and the dorsal first web space of the hand (32) simultaneously. For an instrument held in the right hand, this alignment would be achieved with a clockwise twist (36) having a pitch of 10 to 15 degrees per inch of length. More preferably, the pitch would be between 12 and 13½ degrees per inch, and most preferably the pitch would be 12¾ degrees per inch. The amount of pitch preferable to an individual user may vary according to the size of the user's hand and the personal preferences of the user. When a writing instrument so configured is held in the right hand, as shown in FIG. 4, a first side (12) would be disposed parallel with the surface of the distal end of the index finger (26), the second side (14) would be disposed parallel with the surface of the distal end of the thumb (30), the third side (16) would be disposed parallel with the surface of the distal end of the middle finger (28), and the third side (16) would also be disposed parallel with the surface of the dorsal first web space of the hand (32), between the index finger (26) and the thumb (30).

As shown in FIG. 1, the proximal end (22) of the instrument (pencil) (11) has a flat equilateral triangular configuration prior to sharpening. Also shown in FIG. 1, the distal end (24) of the instrument preferably has an eraser (42) and which, due to its short length, may either be formed in a conforming spiral twist or may be cylindrical without adversely affecting the desired properties of the instrument (11). Alternatively, the writing instrument (11) may lack the eraser, as shown in FIG. 5.

Figure 5:
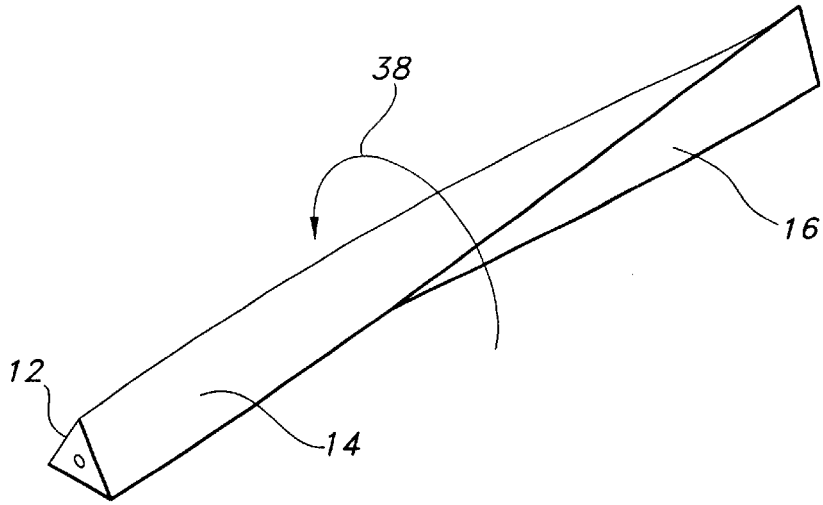
FIG. 5 is a perspective view of an alternative embodiment of the writing instrument for holding in the left hand, and shown with the alternative embodiment of the instrument without an eraser.

For using the instrument in the left hand of the user, the direction of the spiral would necessarily be counter-clockwise (38), as shown in FIG. 5, thereby disposing the same surface (16) against both the distal end of the middle finger and the dorsal first web space of the left hand In use, the instrument (11) when in the form of a pencil, has a sharpened writing point (50) which is the result of sharpening the proximal end (22) to a point (50) so that the lead (20) is suitable for writing. A preferable pencil would have a preferred length from proximal end (22) to distal end (24) of up to 10 inches, more preferably 6½ to 8 inches, and most preferably 7 inches, and preferably each side (12, 14, 16) has a width of approximately a quarter inch to three eighths of an inch. The writing element (20) may be a graphite lead, in the case of a pencil, or an ink cartridge with a writing nib at the proximal end (22) in the case of a pen. Common pen nibs include ball points, felt tips, or roller balls.

Figure 6:
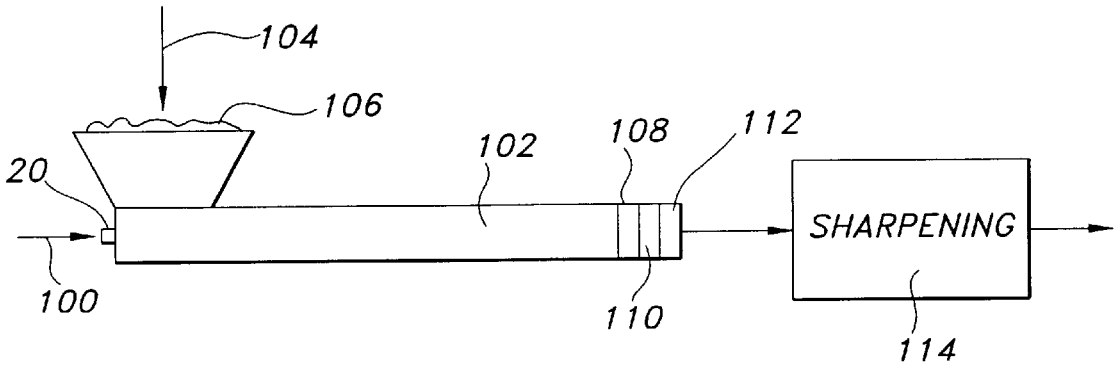
FIG. 6 is a schematic of an extrusion process for making the writing instruments of the present invention.

As shown in FIG. 6, the writing instrument may be made by extruding a body compound about a writing lead, for example a suitable body compound may be a thermoplastic or thermoset composition, and a suitable compound may be a wood powder/glue mixture having suitable levels of wood powder to have desired properties for sharpening of the instrument (11) and having sufficient levels of glue for the flowability of the wood powder. Conventional wood powders and conventional fast-hardening wood glues may be used in the (coextrusion, extrusion) process. The process involves feeding (100) a lead (20) to a extruder (102), feeding (104) a body compound (106) to the extruder (102), extruding (coextruding) the body compound in fluid form and the lead (20) to surround the lead with body compound, shaping (108) the body compound about the lead by forcing the fluid body compound and the lead through a slowly rotating triangular die to produce a spiral triangular cross-sectional body about the lead, hardening (110) the body compound about the lead by cooling or by reaction (cross-linking); and (112) cutting the body/lead to produce an unsharpened writing instrument. The instrument may then be sharpened (114) by a conventional sharpener. Suitable wood powder may be a pine wood powder.

Figure 7:
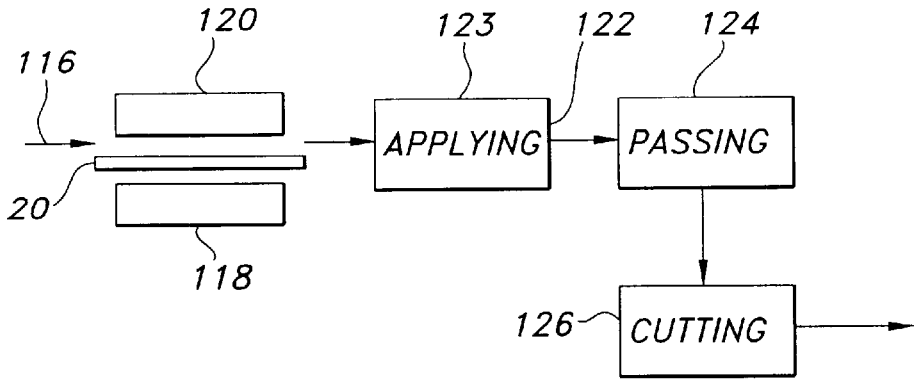
FIG. 7 is a schematic of a shaving process for making the writing instruments of the present invention.

As shown in FIG. 7, the writing instrument may also be produced by feeding (116) a lead (20) between two rectangular body halves of wood (118, 120), applying glue (123) to at least one grooved surface of one of said halves, pressing said wooden halves (118, 120) to form a square block (122), allowing said glue to fixedly attach said halves together, passing (124) said wooden block (122) through a triangular shaver in a relative rotational arrangement to produce a spiraled body contain the lead, and cutting (126) the block (122) to produce the unsharpened writing instrument. The writing instrument may then be sharpened with a conventional sharpener.

In Patent '671, issued to the present inventor, disclosed an ergonomic instrument with an overall twist of 150 to 210 degrees over the full length of the spiral of the instrument. This range of overall twist was the product of the preferred length of 7 inches and the preferred range of pitch of 21 to 30 degrees per inch, essentially twice the pitch of the invention disclosed above. As described in Patent '671, an instrument manufactured into a spiral with a pitch of 21 to 30 degrees achieved an ergonomic fit when disposed in the right hand of the user when the spiral was counter-clockwise. Likewise, an ergonomic disposition would be achieved in the left hand of a user with a clockwise spiral having the preferred pitch of 21 to 30 degrees.

The overall twist is, necessarily, the multiplicative product of the pitch of the spiral and the overall length of the spiral. The ergonomic disposition is a result of the direction and pitch of the spiral, independent of the length of the spiral, and thus of the overall twist. In Patent '671, the invention claimed therein was specified in terms of overall twist based on the preferred 7 inch length. While the overall twist is proportional to the pitch of the spiral when the overall length of the spiral is fixed, its use as a limitation unnecessarily limits the range of lengths for a writing instrument having the desired spiral pitch of 21 to 30 degrees per inch. For example, an instrument having a counter-clockwise spiral pitch of 22 degrees per inch and a length of 6½ inches could be ergonomically disposed in a user's right hand, but would only have an overall twist of 143 degrees, outside the scope of the claims in Patent '671.

In solving the limitations of the '671 patent, another embodiment of the present invention is a writing instrument comprising an elongated body having a uniform equilateral triangular cross-section along the length thereof said body having a uniform spiral around its central axis of a pitch between 21 and 30 degrees per inch of length thereof, wherein the overall twist of the spiral section is less than 150 degrees or greater than 210 degrees and a writing element within said body. This embodiment is manufactured by the same means as previously described herein, by either enclosing a lead (20) within two halves of wood (118, 120) to form a block (122) using glue (123) and subsequently passing (124) the wooden block (122) through a triangular shaver and cutting (126) the block (122) to the desired writing instrument, or by coextrusion of a writing element with a mixture of wood powder and glue.

To use this embodiment to achieve the desired ergonomic alignment between the three flat sides (12, 14, 16) of the instrument and the thumb (30), index finger 26), middle finger (28) and dorsal first web (32) simultaneously, the orientation would be opposite that of the prior embodiments, i.e., an instrument with a counter-clockwise spiral would be held in the right hand, while one with a clockwise spiral would be held in the left hand.

I claim:

1. A writing instrument comprising:

(a) an elongated body having a uniform equilateral triangular cross-section along the length thereof, said cross-section being configured into a uniform spiral around the body's central axis of a pitch between 10 and 15 degrees per inch of length thereof; and (b) a writing element within the body;

(c) the overall twist of the spiral is less than 150 degrees.

2. The writing instrument of claim 1 wherein the pitch of the spiral is between 12 degrees and 13½ degrees per inch of length.

3. The writing instrument of claim 1, wherein the pitch of the spiral is 12¾ degrees per inch of length.

4. The writing instrument of claim 1, wherein said body is wood and said writing element is graphite lead.

5. The writing instrument of claim 1, and further comprising an eraser rigidly attached to the distal end of the writing instrument.

6. The writing instrument of claim 1, wherein the three sides of the equilateral triangular cross section each has an equal width of between ¼ and ⅜ of an inch.

7. A writing instrument comprising:

(a) an elongated body having a uniform equilateral triangular cross-section along the length thereof said body having a uniform spiral around its central axis of a pitch between 21 and 30 degrees per inch of length thereof, wherein the overall twist of the spiral section is less than 150 degrees or greater than 210 degrees; and (b) a writing element within said body.

* * * * *